United States Patent [19]

Turnier

[11] 3,978,277

[45] Aug. 31, 1976

[54] HIGH VOLTAGE TERMINAL BUSHING FOR USE IN HIGH VOLTAGE CIRCUITS

[75] Inventor: Robert H. Turnier, Laguna Beach, Calif.

[73] Assignee: Hughes Aircraft Company, Culver City, Calif.

[22] Filed: July 28, 1975

[21] Appl. No.: 599,575

Related U.S. Application Data

[63] Continuation-in-part of Ser. No. 433,420, Jan. 14, 1974, abandoned.

[52] U.S. Cl. ..... 174/142; 174/209

[51] Int. Cl.[2] ..... H01B 17/26 H01B/17/42;

[58] Field of Search ..... 174/142, 174/143, 152 R, 152 GM, 153 R, 167, 209

[56] References Cited

UNITED STATES PATENTS

| | | | |
|---|---|---|---|
| 1,730,136 | 10/1929 | Haller | 174/142 |

FOREIGN PATENTS OR APPLICATIONS

| | | | |
|---|---|---|---|
| 1,007,846 | 5/1957 | Germany | 174/142 |
| 1,091,642 | 10/1960 | Germany | 174/153 R |
| 23,486 | 12/1914 | United Kingdom | 174/142 |
| 307,647 | 3/1929 | United Kingdom | 174/142 |
| 725,143 | 3/1955 | United Kingdom | 174/142 |

*Primary Examiner*—Laramie E. Askin
*Attorney, Agent, or Firm*—F. I. Konzem; W. H. MacAllister

[57] ABSTRACT

An insulating bushing in a high voltage system which electrically separates a conductor from a wall through which it passes. Attachment of the bushing to the wall is accomplished by applying metalization to a recess in the bushing body and then by applying solder between the metalization and the wall. The metalization stops short of the sharp corners of the recess so that the solder is also kept away from these sharp corners thereby eliminating sharp corona producing corners or edges.

3 Claims, 5 Drawing Figures

HIGH VOLTAGE TERMINAL BUSHING FOR USE IN HIGH VOLTAGE CIRCUITS

The invention herein described was made in the course of or under a Contract or Subcontract thereunder with the Department of the Navy.

This is a Continuation-in-Part of application Ser. No. 433,420, filed Jan. 14, 1974, now abandoned.

BACKGROUND OF THE INVENTION

1. Field of the Invention

This invention relates to insulating bushings and more particularly to an insulating bushing in a high voltage system which raises the corona inception voltage and thereby avoids glow discharges at the junction of the insulator bushing and the metallic wall of some sort of electrical device.

2. Description of the Prior Art

In the art, ceramic bushings have been used to provide an electrically insulated entrance and exit for connections to electrical devices. The ceramic insulating body has a center conductor and a mounting wall fastened to it. These ceramic bushings have often been the source of corona in high voltage systems. Corona is the discharge of electricity appearing as a bluish-purple glow on the surface of and adjacent to a conductor when the voltage gradient exceeds a certain critical value. The corona is due to the ionization of the surrounding air by the high voltage. A detailed discussion on high voltage corona in bushings is given in *Gaseous Conductors*, written by James D. Cobine, 1958. In the prior art, a layer of electrically conductive material was placed between the insulating bushing and its retaining mounting, thus reducing the formation of flow discharges about the insulating bushing. Such a prior art system can be seen in U.S. Pat. No. 1,730,136 entitled, "Insulating Bushing," filed Feb. 27, 1926, by A. Haller.

Bell Telephone Laboratories has recognized that the mounting wall-bushing body area is critical when dealing with corona. The Bell Laboratories have attempted to raise the corona inception voltage of the ceramic bushing by shielding the air near the mounting area by an internal metal film and shielding the top of the bushing.

Corona inception voltage varies with the structural contour. At a sharp edge, such as the junction of the bushing and wall, the corona inception voltage is low. The prior art shielded such edges.

The apparatus of the invention eliminates the sharp metallic edges of the bushing, therefore, substantially increasing the corona inception voltage.

SUMMARY OF THE INVENTION

The insulating bushing in accordance with the invention is used to separate an electrical conductor, such as wire, from a metallic wall through which it passes. In the bushing of the invention, a recess in the bushing overlaps the edge of the wall and is used for receiving solder for attachment of the bushing within a hole in the wall. Solder attachment of the surrounding bushing is accomplished by metalization of most of the interior surface of the recess. However, the metalization stops short of the sharp corner of the recess so that the solder stays away from the sharp corner. Since there is no sharp edge of solder or metal along the corner of the recess on the bushing, the chance of corona is greatly reduced since the corona inception voltage is raised.

Accordingly, it is an object of this invention to provide a high voltage insulating bushing.

Another object is to provide a recess on the bushing containing solder for attaching the bushing to a wall.

It is yet another object to apply metalization to most of the interior surface of the recess.

It is yet another object to keep the sharp corner of the recess free from metalization and, therefore, to keep the sharp corner of the recess of the bushing free from solder or electrically conductive material.

The features of the present invention which are believed to be novel are set forth with particularity in the appended claims. The present invention, both as to its organization and manner of operation, may be understood best by reference to the following description, taken in connection with the accompanying drawings.

DETAILED DESCRIPTION

Figure 1:
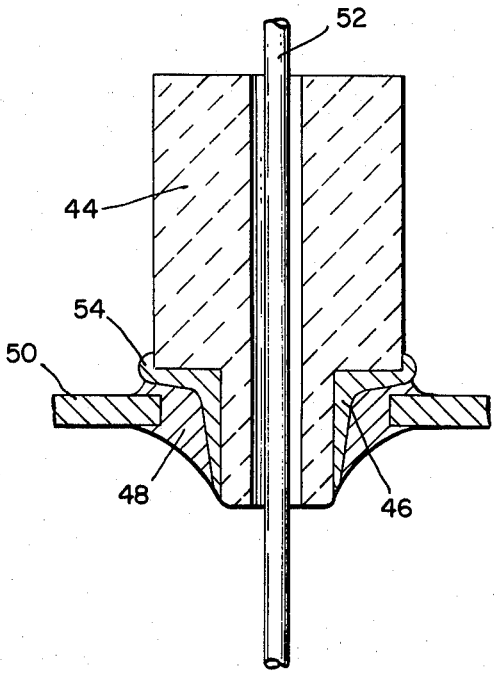
Fig. 1. PRIOR ART
FIG. 1 is a prior art insulating bushing.

In FIG. 1, the prior art high voltage bushing has a bushing body 44, which electrically separates conductive wire 52 from wall 50. Attachment of the bushing body 44 to the wall 50 is accomplished by applying metalization 46 to the bushing body. Solder 48 is then applied to the metalization 46 and to the supportive wall 50. The contour of this prior art bushing lends itself to producing corona since the metalization 46 at point 54 will tend to cause corona between point 54 and the conductive wire 52 protruding from the top of the bushing. It is the objective of this invention to eliminate all sharp conductive points (such as point 54 of the prior art) from the bushing body in order to decrease the possibility of corona occurring.

Figure 2:
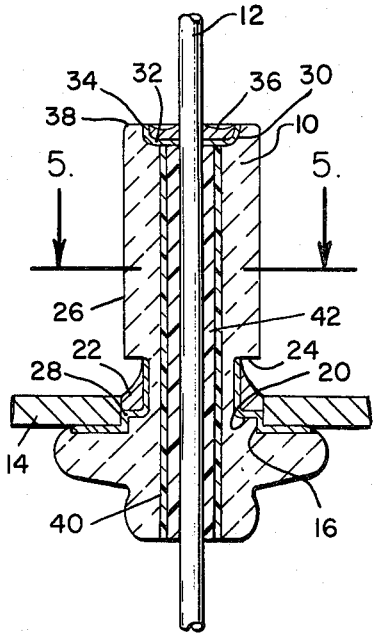
FIG. 2 is a sectional view of the insulating bushing having a structure in accordance with this invention.

Referring now to FIG. 2, the circular insulating bushing 10, which is made of a non-conducting material such as alumina ceramic or porcelain, is positioned to permit a conductor, such as wire 12, to pass through a wall 14, which can conveniently be the wall of some sort of electrical device, such as a transformer or rectifier housing. The purpose of bushing 10 is to electrically separate wire 12 from wall 14. The wall 14 has a circular hole through it, in order to pass the bushing through, and to allow the bushing to be attached to the wall. Shoulder 16 on the bushing provides a locating diameter for the hole in the wall 14. This shoulder 16 engages in the hole and centers the bushing. Recess 20 having a semispherically shaped cross-section overlaps the wall 14 and is for receiving solder 22 for attachment of the bushing within the hole in the wall. Solder attachment to the surrounding bushing is accomplished by applying metalization to most of the interior surface of the recess 20 as shown at 28. However, the metalization stops short of corner 24 of the recess to leave bare ceramic so that the solder 22 stays away from corner 24. There is no sharp edge of solder or of metal directed along the external surface 26 of bushing 10. Since the corona inception voltage at a sharp edge is low, the chance of corona occurring at the corner 24 of the recess, if there was solder, metal or other electrically conductive material at this corner, would be great. Even if a corona is produced, it would be directed down to a common point, the ground plane, wall 14, which has no sharp points.

Figure 3:
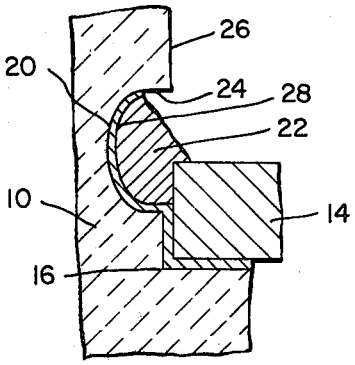
FIG. 3 is an enlarged section of the recess of FIG. 2 with parts broken away.

FIG. 3 is a detailed drawing of the recess 20 and mounting wall 14 of FIG. 1. The metalization 28 of the ceramic bushing extends over the recess 20 and down past the shoulder 16 of the bushing. The purpose of the metalization 28 is to allow the solder 22 to adhere to the ceramic bushing and to allow the wall 14 to adhere to the ceramic bushing. The solder 22 is applied to the metalization 28 in order to attach the bushing to the circular hole in the wall 14, but the metalization stops short of corner 24 to cause the solder to stay below the external surface 26. As explained previously, the solder and metalization must not be applied to the sharp corner 24 in order to reduce the chance of corona.

Figure 4:
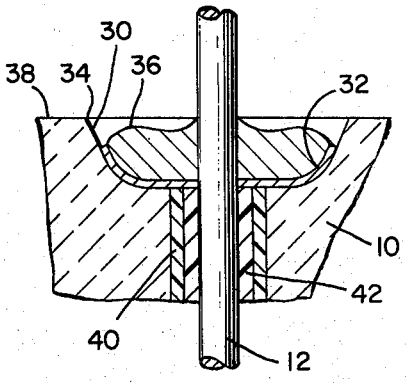
FIG. 4 is an enlarged section of the upper portion of the bushing of FIG. 2 with parts broken away.

FIG. 4 is a detailed drawing of the upper portion of the bushing. In FIG. 4, the bushing 10 has a recess 30, which has metalization 32, but the metalization stops short of corner 34 to leave bare ceramic. The conductor or wire 12 extends into the recess 30, and the solder 36 attaches the wire 12 to the metalization 32 in recess 30. In this way, the solder stays below the surface 38 and raises the corona starting voltage.

Figure 5:
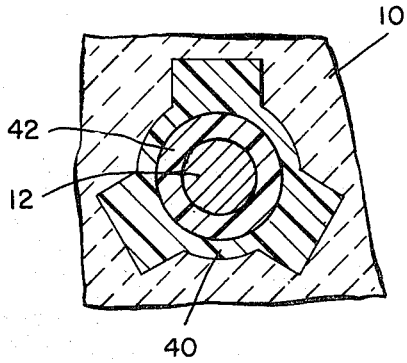
FIG. 5 is an enlarged section of the bushing of the invention with parts broken away, taken along the line 5—5 of FIG. 2.

FIG. 5 is an enlarged section of the bushing with parts broken away taken along the line 5—5 of FIG. 2.

A potting compound 42 is poured between wire 12 and the plastic insulator 40 which eliminates air pockets between the wire and the insulator. Insulator 40 is of a higher resistance than the ceramic material of the bushing body 10 and therefore prevents electrical conduction from the wire 12 to wall 14.

A fixture (not shown) is used to position the wire 12 within insulator 40 while the potting compound 42 is curing.

For a bushing in a 25 kilovolt system, the height of the bushing would be approximately one inch and the diameter approximately one-half inch. Even bushings in the high voltage range can be this small size since the corona inception voltage has been raised due to the elimination of all sharp metallic edges. If the system requires voltages over 25 kilovolts, a bushing can be scaled up larger than the one previously mentioned or scaled down for lower voltages.

Although the device which has just been described appears to afford the greater advantages for implementing the invention, it will be understood that various modifications may be made thereto without going beyond the scope of the invention, it being possible to replace certain elements by other elements capable of fulfilling the same technical function therein.

What is claimed is:

1. A high voltage insulating bushing comprising:
- a substantially circular insulating bushing body;
- a conductor;
- a hole through said bushing body through which said conductor passes;
- means attaching and sealing said conductor to said bushing body;
- a flat wall having a hole with an edge;
- said bushing body electrically separating said conductor from said wall;
- a recess of semispherical shape in cross-section overlapping said edge of the wall;
- a shoulder, beneath said recess, for positioning against said wall;
- metalization applied to said shoulder and to a portion of said recess for application of solder to said metalization for attachment of said bushing body to said wall;
- said recess having two sharp corners at the point where said recess meets the external surface of said bushing body, the first corner having metalization thereon and the second corner of said recess being free of metalization in order to eliminate corona from said bushing body and said conductor;
- solder applied to said metalization and securing said bushing body to said wall, said solder stopping short of said second corner;
- a plastic insulator for insulating said conductor; and
- said insulator being positioned in said hole through said bushing body between said bushing body and said conductor.

2. A bushing as recited in claim 1, wherein said bushing body is made of alumina ceramic.

3. A bushing as recited in claim 1, wherein potting material is positioned between said insulator and said conductor for eliminating air pockets.

* * * * *